US009553364B2

(12) United States Patent
Williams

(10) Patent No.: US 9,553,364 B2
(45) Date of Patent: Jan. 24, 2017

(54) LIQUID CRYSTAL FILLED ANTENNA ASSEMBLY, SYSTEM, AND METHOD

(71) Applicant: THE BOEING COMPANY, Chicago, IL (US)

(72) Inventor: John D. Williams, Decatur, AL (US)

(73) Assignee: The Boeing Company, Chicago, IL (US)

( * ) Notice: Subject to any disclaimer, the term of this patent is extended or adjusted under 35 U.S.C. 154(b) by 14 days.

(21) Appl. No.: 14/739,190

(22) Filed: Jun. 15, 2015

(65) Prior Publication Data

US 2016/0365634 A1 Dec. 15, 2016

(51) Int. Cl.
*H01Q 3/44* (2006.01)
*H01Q 21/29* (2006.01)

(52) U.S. Cl.
CPC ..... *H01Q 3/446* (2013.01); *H01Q 21/29* (2013.01)

(58) Field of Classification Search
CPC ..... H01Q 3/446; H01Q 21/19
USPC ..... 343/702, 770, 718, 833
See application file for complete search history.

(56) References Cited

U.S. PATENT DOCUMENTS 5,898,405 A * 4/1999 Iwasaki ..... H01Q 1/38 343/700 MS
6,927,827 B2 * 8/2005 Jung ..... G02F 1/134363 349/123
7,061,435 B2 * 6/2006 Lin ..... G06F 1/182 343/702
7,277,059 B2 * 10/2007 Lin ..... H01Q 1/22 343/718
7,868,267 B2 * 1/2011 Tanaka ..... B23K 26/067 219/121.6
8,081,127 B2 * 12/2011 Chen ..... H01Q 1/243 343/702
2010/0073238 A1 * 3/2010 Jun ..... H01Q 9/0457 343/700 MS
2012/0274527 A1 * 11/2012 Ayatollahi ..... H01Q 1/38 343/770

FOREIGN PATENT DOCUMENTS

GB 2225122 5/1990
JP H11 136022 5/1999
WO WO 2012080532 6/2012

OTHER PUBLICATIONS

Christogoulou, Tawk, Lane, Erwin, "Reconfigurable Antennas for Wireless and Space Applications," Proc. of the IEEE, vol. 100, pp. 2250-2261 , 2012.
W. Hu, et al, "Liquid-crystal-based reflect array antenna with electronically switchable monopulse patterns," Electron. Lett., vol. 43, No. 14, Jul. 2007.

(Continued)

*Primary Examiner* — Jean B Jeanglaude
(74) *Attorney, Agent, or Firm* — Joseph M. Butscher; The Small Patent Law Group, LLC

(57) ABSTRACT

An antenna assembly may include a ground shield defining an interior chamber, a feed line coupled to the ground shield within the interior chamber, a plurality of dielectric members, and a plurality of liquid crystal members. Each of the plurality of liquid crystal members may be spaced apart from another of the liquid crystal members by at least one of the plurality of dielectric members.

20 Claims, 5 Drawing Sheets

(56) References Cited

OTHER PUBLICATIONS

L. Liu and R. J. Langley, "Liquid crystal tunable microstrip patch antenna," Electron. Lett., vol. 44, No. 20, pp. 1179-1180, Sep. 2008.
A. Polycarpou, M. Christou, N. Papanicolaou, "Tunable Patch Antenna Printed on a Biased Nematic Liquid Crystal Cell," IEEE Transactions on Antennas and Propagation, vol. 62, pp. 4980-4987. 2014.
C. Woehrle, et al, "Liquid Crystal Reconfigurable Circularly Polarized Patch Antenna," IEEE International Sympositum on Antennas and Propogation, pp. 561-562 (2014).
Extended European Search Report for EP app. 16170413.5-1811, dated Nov. 15, 2016.

* cited by examiner

LIQUID CRYSTAL FILLED ANTENNA ASSEMBLY, SYSTEM, AND METHOD

FIELD OF THE DISCLOSURE

Embodiments of the present disclosure generally relate to liquid crystal filled antenna assemblies, systems, and methods, and, more particularly, to systems and methods for tuning antenna assemblies through photonic patterns of liquid crystal materials.

BACKGROUND OF THE DISCLOSURE

Antennas may be used in various applications, such as with respect to cellular phone communication, satellite reception, remote sensing, military communication, and the like. As an example, printed circuit antennas generally provide low-cost, light-weight, low-profile structures that are relatively easy to mass produce. These antennas may be designed in arrays and used for radio frequency systems, such as identification of friend/foe (IFF) systems, radar, electronic warfare systems, signals intelligence systems, line-of-sight communication systems, satellite communication systems, and the like.

A known antenna includes a feed line that is configured to send and receive signals, and a ground plate. To send a signal through an antenna, a bias voltage is applied through the feed line, which then radiates from the end of the feed line. The ground plate is configured to guide a shape of the emitted radiation from the feed line.

A cylindrical antenna is a known type of antenna that includes an outer cylindrical conductor, which provides a ground plate, and a central wire, which provides a feed line. The outer cylindrical conductor is a tubular structure that acts as a signal collector, while the central wire acts as a transmitter and receiver. Typically, a cylindrical antenna includes a dielectric fill between the central wire and the ground plate. The dielectric fill may include a plastic, Teflon, or the like.

The shape of an antenna causes a shape of a field emitted from and received by the antenna to be at a particular angle. When the antenna is pointed in a particular direction, reception of the field is greatest in relation to the particular direction. However, if a field or signal is off axis from the direction, reception may be attenuated or otherwise degraded.

Further, many antenna assemblies include multiple antenna units in an array. When all the antenna units are pointed in the same direction, a phase angle error may occur as a signal or field wave is received by such an assembly. For example, certain antenna units receive the signal or field wave before other antenna units, which may cause phase errors. Phase array antenna assemblies typically compensate for such phase errors in order to ensure desired signal resolution. However, methods for compensating for phase errors may be complex, and consume time and energy.

A need exists for improved and efficient methods of reducing phase and coupling errors associated with phase array antennas.

SUMMARY OF THE DISCLOSURE

Certain embodiments of the present disclosure provide an antenna assembly that may include a ground shield defining an interior chamber, a feed line coupled to the ground shield within the interior chamber, a plurality of dielectric members, and a plurality of liquid crystal members. Each of the liquid crystal members may be spaced apart from another of the liquid crystal members by at least one dielectric member.

A permittivity of each of the plurality of liquid crystal members changes based on application of a liquid crystal altering bias (for example, a voltage bias) through the feed line. The antenna assembly may be tuned to accept different phase angles through application of the liquid crystal altering bias. The liquid crystal altering bias is applied at a first frequency that differs from a second frequency of a signal radiating bias that may be concurrently applied through the feed line.

The dielectric members and the liquid crystal members may form a periodic pattern within the antenna assembly. In at least one embodiment, the liquid crystal members include a plurality of liquid crystal layers that extend between an inner surface of the ground shield to the feed line. In at least one embodiment, the liquid crystal members include a plurality of concentric liquid crystal layers, and the dielectric members include a plurality of concentric dielectric cylinders. In at least one embodiment, the liquid crystal members may include a first set of liquid crystal layers that extend between an inner surface of the ground shield to the feed line, and a second set of concentric liquid crystal layers that are orthogonal to the first set of liquid crystal layers. In at least one embodiment, the liquid crystal members include a three dimensional array of liquid crystal members within the ground shield.

Each of the liquid crystal members may be formed of the same liquid crystal material. Optionally, at least two of the liquid crystal members may be formed of a different liquid crystal material.

Certain embodiments of the present disclosure provide a method of operating an antenna assembly. The method may include applying a signal-radiating bias at a first frequency to a feed line that is coaxial with a ground shield, and applying a liquid crystal altering bias at a second frequency that differs from the first frequency to the feed line. The applying a liquid crystal altering bias operation alters a relative permittivity between a plurality of liquid crystal members and a plurality of dielectric members within the ground shield.

Certain embodiments of the present disclosure provide an antenna system that may include an antenna assembly, and a control unit. The antenna assembly may include a ground shield defining an interior chamber, a feed line coupled to the ground shield within the interior chamber, a plurality of dielectric members, and a plurality of liquid crystal members. Each of the liquid crystal members may be spaced apart from another of the liquid crystal members by at least one of the dielectric members. The dielectric members and the plurality of liquid crystal members form a periodic pattern within the antenna assembly. The control unit is operatively coupled to the feed line. The control unit is configured to apply a signal-radiating bias at a first frequency through the feed line and a liquid crystal altering bias at a second frequency that differs from the first frequency through the feed line.

DETAILED DESCRIPTION OF THE DISCLOSURE

Figure 1:
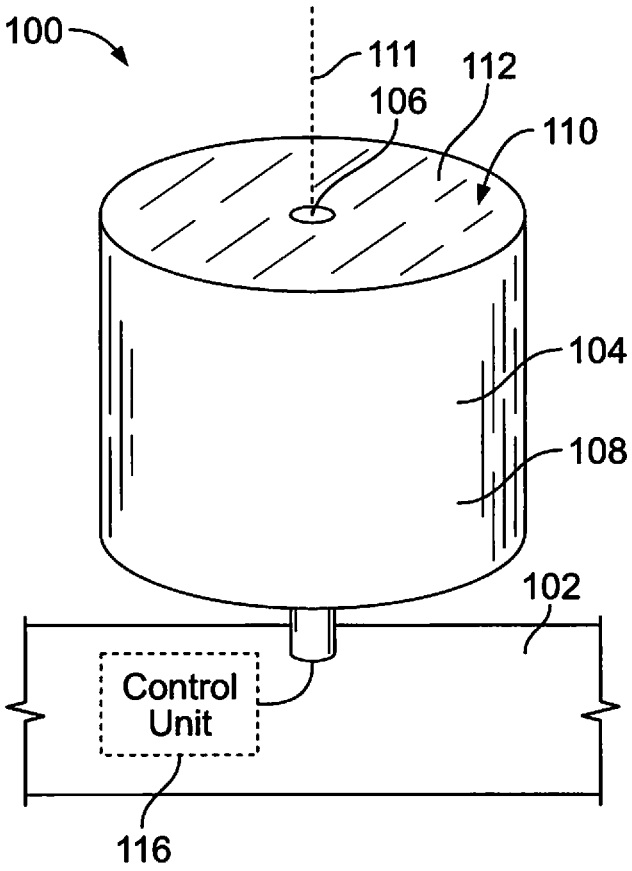
FIG. 1 is a diagrammatic representation of a perspective view of an antenna assembly secured to a structure, according to an embodiment of the present disclosure.

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Embodiments of the present disclosure provide systems and methods by which an antenna assembly may be tuned to accept different phase angles and/or wavelengths by filling a volume in proximity to a first conductor, such as a feed line or wire, and a second conductor, such as a ground plane, plate, line, or the like. In at least one embodiment, an antenna assembly includes a periodic array of low loss and liquid crystal (LC) dielectrics. Low frequency biasing of the liquid crystal provides a sweep of an effective permittivity surrounding the first conductor (e.g., the feed line) relative to the second conductor (e.g., the ground plane), thereby modifying a phase and frequency of a received and/or transmitted signal. Further, periodic coupling of several liquid crystal layers may amplify the effect near a resonance frequency of a spatial period, which, in turn, may improve narrow band sweeping of the antenna at a frequency near the spatial period. In at least one embodiment, the periodic structure (which may include a regular, repeating pattern of dielectric material and liquid crystal material) may exhibit an index change that may be alternated with relative ratios greater than 1.5:1 between the dielectric material and the liquid crystal material. The alternate path angle results in an increased or decreased path length between an input and the ground, which results in a change in the acceptance frequency of the antenna.

In at least one embodiment, incident angles and wavelengths of an incoming field of interest may be modulated by the periodic structure in a controlled manner. A one-dimensional dielectric stack may be used with respect to a single angle of incidence, for example. A two-dimensional periodic structure may increase the acceptance angle and wavelength range. A three-dimensional periodic structure may be used to completely modulate an incident electromagnetic field. A periodic ratio of a refractive index may be tuned from a value of 1 to 3, for example. A periodic ratio of permittivities greater than 3 may result in a photonic band gap that prevents signal propagation (for example, antenna reception) at a coupling wavelength. The ability to produce a very high refractive index contrast ratio (for example, greater than 3) within the periodic structure may be used as a switch, which may be selectively activated and deactivated by biasing liquid crystal material of the structure.

Liquid crystal materials demonstrate changes in permittivity at GHz frequency ranges, for example. For example, relative permittivity of liquid crystal materials at 10 GHz vary from 2 to 3.8 under applied bias voltage. These values may be equivalent to a refractive index of 1.4 to 1.95.

Embodiments of the present disclosure provide a system, method, and assembly for dynamically tuning antennas, such as phased array antennas. Embodiments of the present disclosure include a periodic array of liquid crystal materials and dielectrics between a first conductor (such as a feed line, feed wire, or other such active element), and a second conductor (such as a ground plane, ground plate, or other such ground shield). A permittivity of the liquid crystal material may be controlled by a voltage bias, thereby creating an antenna of dynamic transmit/receive characteristics.

FIG. 1 is a diagrammatic representation of a perspective view of an antenna assembly 100 secured to a structure 102, according to an embodiment of the present disclosure. The antenna assembly 100 may include a ground shield 104 (which may be conductor) and a feed line 106 (which may also be a conductor, such as a feed wire). The ground shield 104 may include a cylindrical outer wall 108 that defines an interior chamber 110 in which the feed line 106 is secured. The top of the antenna assembly 100 may be open-ended in order to facilitate transmission and reception of signals therethrough. As shown, the ground shield 104 and the feed line 106 may be coaxial with respect to a central longitudinal axis 111 of the antenna assembly 100.

As described below, the interior chamber 110 may include dielectric members, such as first layers, and liquid crystal members, such as second layers. Both the dielectric members and the liquid crystal members may be dielectric. However, the dielectric members may be fixed and constant dielectric materials, while the liquid crystal members may be adaptive dielectrics that change properties, such as permittivity, based on application of a liquid crystal altering bias, as described below.

Figure 3:
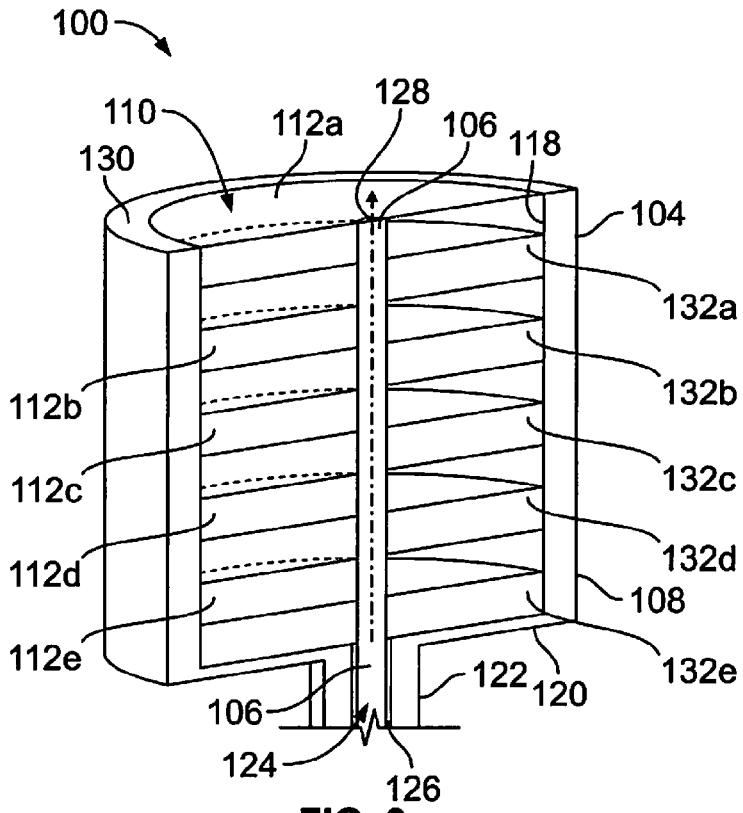
FIG. 3 is a diagrammatic representation of a perspective cross-sectional view of an antenna assembly through line 3-3 of FIG. 2, according to an embodiment of the present disclosure.

The dielectric layers and the liquid crystal layers may form a periodic pattern. The periodic pattern may be a regular repeating pattern. For example, the antenna assembly 100 may include a plurality of liquid crystal layers and a plurality of dielectric layers, such as shown in FIG. 3. Each liquid crystal layer may be sandwiched or otherwise positioned between two dielectric layers. Such a pattern may regularly repeat, thereby forming a periodic pattern. In at least one embodiment, the layers may have similar thicknesses. Optionally, the layers may have different thicknesses.

Each liquid crystal layer may radially extend between an outer surface of the feed line 106 and an interior surface of the ground shield 104. Similarly, each dielectric layer 112 may extend between an outer surface of the feed line 106 and an interior surface of the ground shield 104. In at least one embodiment, the dielectric layers 112 may be positioned between neighboring liquid crystal layers, but may not abut against the feed line 106 and/or the ground shield 104.

Neighboring layers are those that are closest to one another. For example, as shown in FIG. 3, two liquid crystal layers that are separated by a single dielectric layer are considered to be neighboring liquid crystal layers.

The structure 102 may be any type of structure that utilizes an antenna, such as a phased array antenna. For example, the structure 102 may be a cellular telephone, smart device (such as a tablet), a fixed structure (such as a building), a vehicle (such as an aircraft), or the like. The structure 102 may contain or otherwise include a control unit 116 that is operatively coupled to the antenna assembly 100, such as through one or more wired or wireless connections. The control unit 116 is configured to control operation of the antenna assembly.

As used herein, the term "controller," "control unit," "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor capable of executing the functions described herein. Such are exemplary only, and are thus not intended to limit in any way the definition and/or meaning of such terms.

The control unit 116 executes a set of instructions that are stored in one or more storage elements (such as one or more memories), in order to process data. For example, the control unit 116 may include one or more memories. The storage elements may also store data or other information as desired or needed. The storage element may be in the form of an information source or a physical memory element within a processing machine.

The set of instructions may include various commands that instruct the control unit 116 (which may be or include a computer or processor) as a processing machine to perform specific operations such as the methods and processes of the various embodiments of the subject matter described herein. The set of instructions may be in the form of a software program. The software may be in various forms such as system software or application software. Further, the software may be in the form of a collection of separate programs or modules, a program module within a larger program or a portion of a program module. The software also may include modular programming in the form of object-oriented programming. The processing of input data by the processing machine may be in response to user commands, or in response to results of previous processing, or in response to a request made by another processing machine.

The diagrams of embodiments herein may illustrate one or more control or processing units. It is to be understood that the processing or control units may represent circuit modules that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the control units may represent processing circuitry such as one or more of a field programmable gate array (FPGA), application specific integrated circuit (ASIC), microprocessor(s), a quantum computing device, and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

Figure 2:
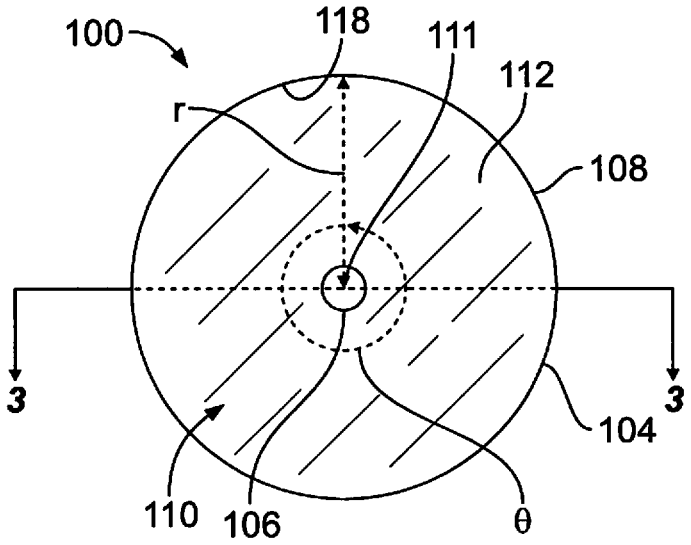
FIG. 2 is a diagrammatic representation of a top plan view of an antenna assembly, according to an embodiment of the present disclosure.

FIG. 2 is a diagrammatic representation of a top plan view of the antenna assembly 100, according to an embodiment of the present disclosure. As shown, the antenna assembly 100 may be a cylindrical antenna assembly in which the ground shield 104 has a circular cross-section. For example, a radius r from the central longitudinal axis 111 to an interior surface 118 of the ground shield 104 may be constant over a 360 degree arcuate sweep angle θ. Alternatively, the antenna assembly 100 may be of various other shapes and sizes than shown. For example, the antenna assembly 100 may have an elliptical cross-section, an irregularly curved cross-section, a rectangular cross-section, a triangular cross-section, or the like.

As shown in FIG. 2, the dielectric layer 112 may be a disc that extends between the feed line 106 and the interior surface 118 of the ground shield 104. Each dielectric layer 112 within the interior chamber 110 of the antenna assembly 100 may be formed in a similar manner. Alternatively, one or more of the dielectric layers 112 may not abut against the feed line 106 and the interior surface 118. However, the outer most dielectric layer 112, such as a top dielectric layer 112, may fully extend between the feed line 106 and the interior surface 118 as shown in FIG. 2 in order to contain one or more liquid crystal members within the interior chamber 110.

FIG. 3 is a diagrammatic representation of a perspective cross-sectional view of the antenna assembly 100 through line 3-3 of FIG. 2, according to an embodiment of the present disclosure. The outer wall 108 of the ground shield 104 connects to a base 120, which may be a flat, planar base 120 that is perpendicular to the outer wall 108. A guide tube 122 extends downwardly from the base 120 and defines an interior channel 124. A dielectric fill sleeve 126 is disposed within the interior channel 124 and separates a lower segment of the feed line 106 from the guide tube 122. The feed line 106 extends through the guide tube 122 into the interior chamber 110, such that a distal tip 128 may extend to a level of a terminal edge 130 of the ground shield 104. Optionally, the distal tip 128 may be recessed below or extend above the level of the terminal edge 130.

As shown, a plurality of dielectric members in the form of planar dielectric layers 112*a-e* and liquid crystal members in the form of liquid crystal layers 132*a-e* are positioned within the interior chamber 110. Each liquid crystal layer 132*a-e* may be formed of a liquid crystal material. Each liquid crystal layer 132*a-e* may be formed of the same or a different liquid crystal material. The antenna assembly 100 provides a periodic pattern of dielectric layers 112*a-e* and liquid crystal layers 132*a-e*. For example, each single dielectric layer 112*a-e* separates neighboring liquid crystal layers 132*a-e*, and such pattern repeats throughout the interior chamber 110. The periodic pattern exhibits an alternating stacked pattern of liquid crystal layers 132*a-e* and dielectric layers 112*a-e*.

The liquid crystal layer 132*e* is supported on an upper surface of the base 120 and extends between the feed line 106 and the interior surface 118 of the ground shield 104. In at least one embodiment, the liquid crystal layer 132*e* may be poured directly into the interior chamber 110 to a desired depth. After the liquid crystal layer 132*e* is positioned within the interior chamber, the dielectric layer 112*e* may be positioned over the liquid crystal layer 132*e*. The dielectric layer 112*e* may extend between the feed line 106 and the interior surface 118 of the ground shield 104. Next, the liquid crystal layer 132*d* is poured over the dielectric layer 112*e* to a desired depth. The remaining liquid crystal layers 132 and dielectric layers 112 may be formed in a similar manner.

A liquid crystal is matter in a state that has properties between those of liquid and those of solid crystal. For example, a liquid crystal may flow like a liquid, and have molecules oriented in a crystal-like pattern. The molecules of the liquid crystal are oriented in a particular direction. Upon application of a liquid crystal altering bias voltage at a particular frequency, the molecules are polarized in a different direction, thereby altering the liquid crystal's permittivity.

Each dielectric layer 112*a-e* may be formed of a plastic, ceramic, or glass material, or the like. In at least one embodiment, each dielectric layer 112*a-e* may be formed of Teflon, particularly when used with respect to microwave frequencies. Each dielectric layer 112*a-e* may be formed of the same material. Optionally, two or more of the dielectric layers 112*a-e* may be formed of different dielectric materials. Each dielectric layer 112*a-e* may have the same height or depth. Optionally, two or more of the dielectric layers 112*a-e* may be different heights or depths. Further, the depth or height of each dielectric layer 112*a-e* may be the same as or different from the depth or height of each liquid crystal layer 132*a-e*.

As shown, the antenna assembly 100 may include five dielectric layers 112*a-e* and five liquid crystal layers 132*a-e*. In at least one other embodiment, the antenna assembly 100 may include more or less dielectric layers and liquid crystal layers than shown. For example, the antenna assembly 100 may include three dielectric layers and three liquid crystal layers. As another example, the antenna assembly 100 may include ten dielectric layers and ten liquid crystal layers.

As shown, neighboring (that is, those that are closest to one another) liquid crystal layers 132*a-e* are separated from one another by one of the dielectric layers 112*a-e*. For example, the neighboring liquid crystal layers 132*a* and 132*b* are separated by and spaced apart from one another by the dielectric layer 112*b*. The neighboring liquid crystal layers 132*b* and 132*c* are separated by and spaced apart from one another by the dielectric layer 112*c*. The neighboring liquid crystal layers 132*c* and 132*d* are separated by and spaced apart from one another by the dielectric layer 112*d*. The neighboring liquid crystal layers 132*d* and 132*e* are separated by and spaced apart from one another by the dielectric layer 112*e*. In this manner, the dielectric layers 112*a-e* may prevent neighboring liquid crystal layers 132 from fusing or otherwise flowing into one another.

The periodic (for example, regular and repeating), alternating configuration of dielectric layers 112*a-e* and liquid crystal layers 132*a-e* allows an overall permittivity within the antenna assembly 100 to be modified in order to compensate for phase differences and/or to send and receive signals in different orientations. Permittivity is a measure of how an electromagnetic field affects, and is affected by, a dielectric medium. The antenna assembly 100 is configured to allow for changes in permittivity in the interior chamber 110 by varying a voltage bias between first and second magnitudes.

As noted, liquid crystals are molecules that change orientations at different frequencies. For example, each liquid crystal layer 132*a-e* may be a liquid crystal solution of liquid or polymer. The liquid crystal molecules within each liquid crystal layer 132-*e* have a directional orientation. At a first voltage bias or lack thereof, the liquid crystal molecules within each liquid crystal layer 132*a-e* exhibit a first directional orientation. At a second voltage bias that differs from the first voltage bias, the liquid crystal molecules within each liquid crystal layer 132*a-e* exhibit a second directional orientation that differs from the first directional orientation. In short, the effective permittivity of each liquid crystal layer is different at different applied voltage biases.

A voltage bias between the feed line 106 and the ground shield 104 polarizes the liquid crystal layers and changes the relative permittivity thereof (and the antenna assembly 100 in general). At GHz frequencies (such as associated with a voltage bias), for example, the relative permittivity may change from 2.2 to 3.8, for example. As the relative permittivity of the antenna assembly changes, an electromagnetic propagation constant of a signal (such as field incident on the liquid crystal layers) changes, thereby altering a path length and angle of the signal within the antenna assembly 100. Accordingly, a resonant frequency of the antenna assembly 100 changes. A direction, and therefore a path length, of a signal, such as an incident wave, is modified by differences in relative permittivity (and therefore refractive index) between the liquid crystal layers and the dielectric layers.

Referring to FIGS. 1-3, the control unit 116 may apply a liquid crystal altering bias through the feed line 106 at the same time as a signal-radiating bias. The liquid crystal altering bias and the signal-radiating bias may be applied at different frequencies at the same time through the feed line 106. That is, the liquid crystal altering bias and the signal-radiating bias may be separate and distinct biases or voltages at separate and distinct frequencies. Further, the liquid crystal altering bias and the signal-radiating bias may be applied on the same feed line 106. The liquid crystal altering bias is configured to alter the permittivity of the liquid crystal layers 132*a-e*, while the signal-radiating bias is configured to radiate a signal or field from the antenna assembly. The liquid crystal altering bias may be at a lower frequency than the signal-radiating bias. For example, the liquid crystal altering bias may be at a frequency between 0.1 Hz to 30 KHz, while the signal-radiating bias may be a frequency in a GHz or MHz range.

In at least one embodiment, when no liquid crystal altering bias is applied to the feed line 106, the permittivity of the liquid crystal layers 132*a-e* may be 2 or 2.5, for example. In response to a liquid crystal altering bias being applied through the feed line 106 at a frequency of 10 KHz, the permittivity of the liquid crystal layers 132*a-e* may change from 2 or 2.5 to 3.5 or 4, for example.

The control unit 116 may apply the liquid crystal altering bias through the feed line 106 at the same time that it applies the separate and distinct signal-radiating bias through the feed line 106. The liquid crystal altering bias changes the permittivity between the ground shield 104 and the feed line 106. For example, the permittivity may change from 2 to 4. The permittivity of each dielectric layer 112*a-e* may remain the same as the liquid crystal altering bias is applied to the feed line 106. That is, the liquid crystal altering bias may not affect the dielectric layers 112*a-e*. The permittivity of each dielectric layer 112*a-e* may remain constant whether the liquid crystal altering bias is applied to the feed line 106 or not. For example, if the dielectric layers 112*a-e* are formed of Teflon, for example, the permittivity of each dielectric layer 112*a-e* may be a constant of around 3.1

As an incoming signal (such as an electromagnetic field or wave) impinges on the antenna assembly 100 from a particular angle, the incoming signal is redirected at a different angle within the interior chamber 100 based on the variations in permittivity between the dielectric layers 112-*e* and the liquid crystal layers 132*a-e*.

Figure 4:
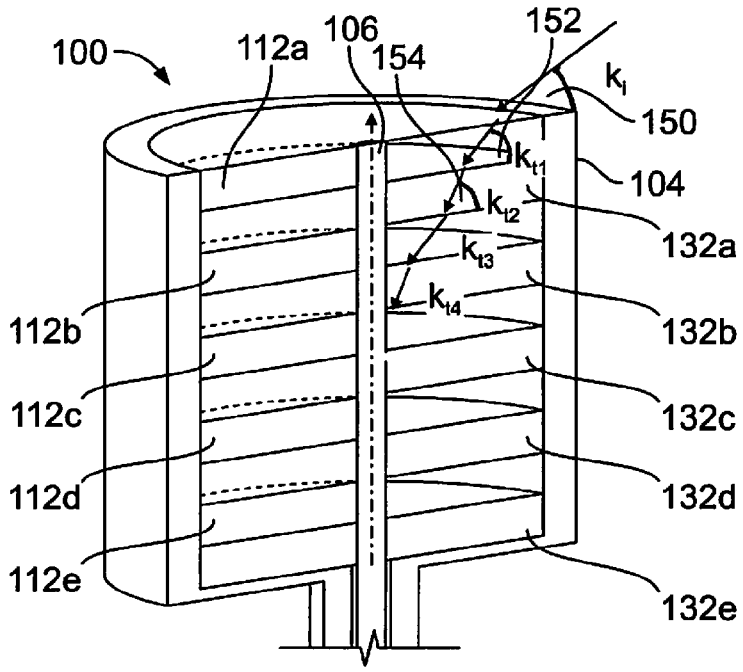
FIG. 4 is a diagrammatic representation of a perspective cross-sectional view of an antenna assembly receiving an incoming signal, according to an embodiment of the present disclosure.

FIG. 4 is a diagrammatic representation of a perspective cross-sectional view of the antenna assembly 100 receiving an incoming signal $k_i$, according to an embodiment of the present disclosure. The incoming signal $k_i$ may be a wave vector of a signal wave that is received by the antenna assembly 100. As shown, the incoming signal $k_i$ may impinge upon the dielectric layer 112*a* at an angle 150 with respect to a top planar surface of the dielectric layer 112*a*. As the incoming signal $k_i$ passes into the dielectric layer 112*a*, the incoming signal $k_i$ bends at an angle 152 with respect to dielectric layer 112*a* due to the permittivity of the dielectric layer 112*a*, thereby forming a signal $k_{t1}$. As the signal $k_{t1}$ passes through the dielectric layer 112*a* into the liquid crystal layer 132*a*, the permittivity of the liquid crystal layer 132*a* causes the signal $k_{t1}$ to bend at an angle 154 due to the difference in permittivity between the liquid crystal layer 132*a* and the dielectric layer 112*a*, thereby forming signal $k_{t2}$.

The angle 154 changes in response to the liquid crystal altering bias being applied through the feed line 106. Thus, when no liquid crystal altering bias is applied, the angle 154 is a first value, and when the liquid crystal altering bias is applied, the angle 154 is a second value that differs from the first value. The liquid crystal altering bias may be selectively applied and deactivated in order to shape the incident angle of a received incoming signal and/or a direction of a transmitted signal from the feed line generated by an applied signal-radiating bias. As the incoming signal travels through the alternating layers, the differing permittivities of the layers bend the signals therethrough. For example, the signal $k_{t3}$ is through the dielectric layer 112*b*, the signal $k_{t4}$ is through the liquid crystal layer 132*b*, and so on.

Notably, each dielectric layer 112*a-e* may be formed of the same or different dielectric materials. If formed of the same dielectric material, each dielectric layer may have the same permittivity and may affect the signal in a similar manner. If formed of a different dielectric material and/or having different thicknesses, each dielectric layer may have a different permittivity, and therefore affect the signal in a different manner.

Similarly, each liquid crystal layer 132*a-e* may be formed of the same or different liquid crystal materials. If formed of the same liquid crystal material, each liquid crystal layer has a first permittivity when no liquid crystal altering bias is applied, and a second permittivity when the liquid crystal altering bias is applied. If formed of a different liquid crystal material, each liquid crystal layer may have different first permittivities when no liquid crystal altering bias is applied, and different second permittivities (which differ from the different first permittivities) when a liquid crystal altering bias is applied.

By changing an incident angle of the incoming signal through application of the liquid crystal altering bias, the phase of the incoming signal may be altered. Through application of the liquid crystal altering bias, the permittivity of each liquid crystal layer 132*a-e* changes, which therefore changes the incident angle of the incoming signal from the ground shield 104 to the feed line 106.

Referring to FIGS. 2-4, each of the liquid crystal layers 132*a-e* may provide a contiguous layer of liquid crystal material from the interior surface 118 of the ground shield 104 to the feed line 106 in a linear direction. As such, each liquid crystal layer 132*a-e* may provide a uniform signal therethrough to the feed line 106. The liquid crystal layers 132*a-e* provide a periodic, one dimensional stack. The stack is periodic in that is regular repeats and alternates between dielectric layers 112*a-e* and liquid crystal layers 132*a-e*. The stack is one dimensional in that the liquid crystal layers 132*a-e* affect a signal or wave through a changing permittivity relative to the radius r, as shown in FIG. 2.

Figure 5:
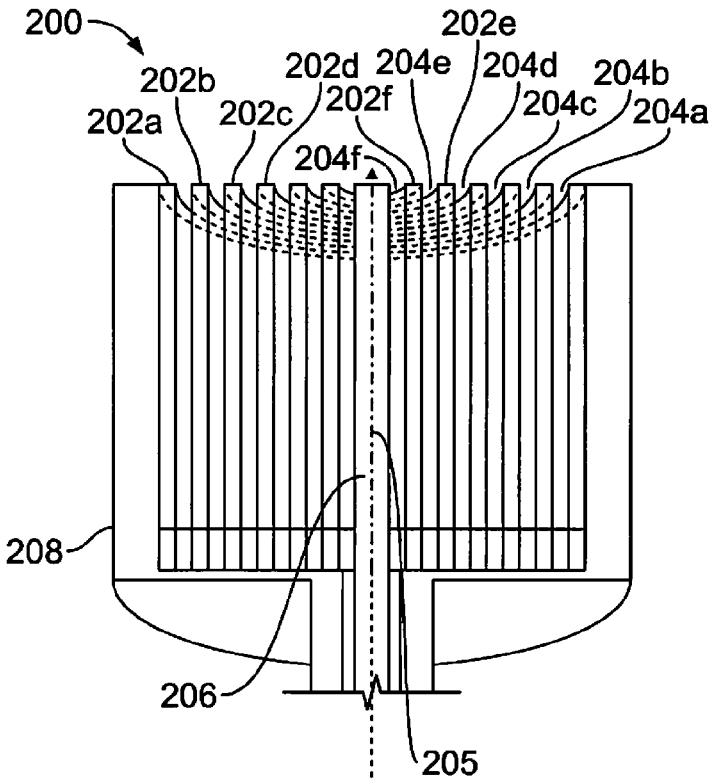
FIG. 5 is a diagrammatic representation of a perspective cross-sectional view of an antenna assembly, according to an embodiment of the present disclosure.
Figure 6:
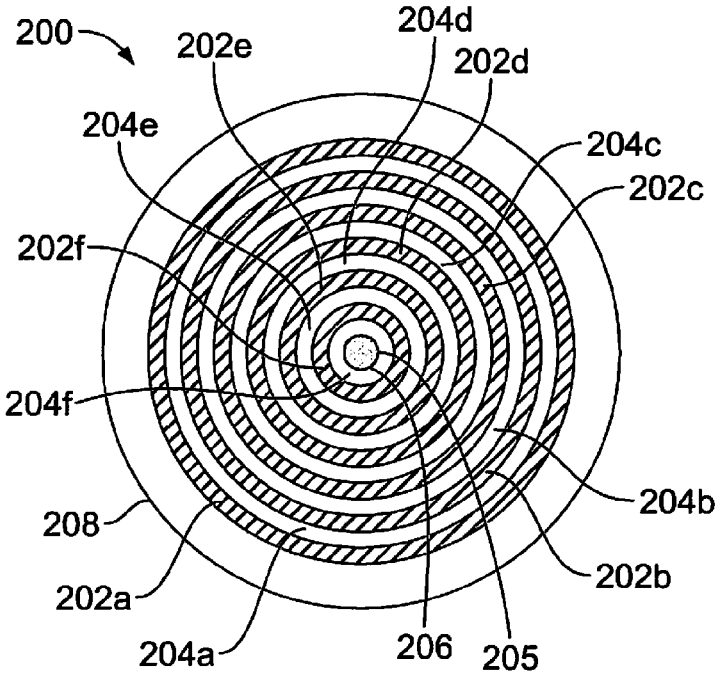
FIG. 6 is a diagrammatic representation of a top plan view of an antenna assembly, according to an embodiment of the present disclosure.

FIG. 5 is a diagrammatic representation of a perspective cross-sectional view of an antenna assembly 200, according to an embodiment of the present disclosure. FIG. 6 is a diagrammatic representation of a top plan view of the antenna assembly 200. Referring to FIGS. 5 and 6, the antenna assembly 200 is similar to the antenna assembly 100. The liquid crystal members are in the form of concentric vertical cylinder layers 202*a-f* separated by concentric dielectric members in the form of concentric cylinder layers 204*a-f* between a feed line 206 and a ground shield 208. More or less liquid crystal layers and dielectric layers than shown may be used. Each liquid crystal layer 202*a-f* is concentric with a longitudinal axis 205 of the feed line 206. As shown, the liquid crystal layers 202*a-f* and the dielectric layers 204*a-f* are vertically and/or longitudinally aligned with respect to the longitudinal axis 205.

The liquid crystal layers 202*a-f* provide a one-dimensional periodic stack of liquid crystal material that are spaced apart by the dielectric layers 204*a-f*. The control unit 116 (shown in FIG. 1) may apply liquid crystal altering bias at a higher frequency than described with respect to FIGS. 2-4, in order to ensure that an incoming signal altered by the liquid crystal layers 202*a-f* impinges on the feed line 206 (as each of the liquid crystal layers 202*a-f*, unlike the liquid crystal layers 132*a-f* shown in FIGS. 3 and 4, do not extend between the feed line 206 and the ground shield 208). Thus, while the control unit 116 may apply the liquid crystal altering bias at kHz frequencies, for example, with respect to embodiments shown in FIGS. 2-4, the control unit 116 may apply the liquid crystal altering bias in MHz or GHz frequencies with respect to the embodiment shown in FIGS. 5 and 6.

The width or thickness of each layer may be the same or varied. In at least one embodiment, the width or thicknesses of the layers may provide a symmetrical cross-section. The cylindrical thicknesses of the materials do not have to be the same. Instead, the materials cooperate to provide a periodic symmetry of repeating dielectrics and liquid crystal layers between the feed and ground planes.

The embodiment shown in FIGS. 5 and 6 may be simpler to fabricate than the embodiment shown in FIGS. 2-4. For example, cylindrical dielectric layers 204*a-f* may simply be positioned within the ground shield 208, and then liquid crystal material may then be poured therein, to form the various liquid crystal layers 202*a-f* between the dielectric layers 204*a-f*.

Figure 7:
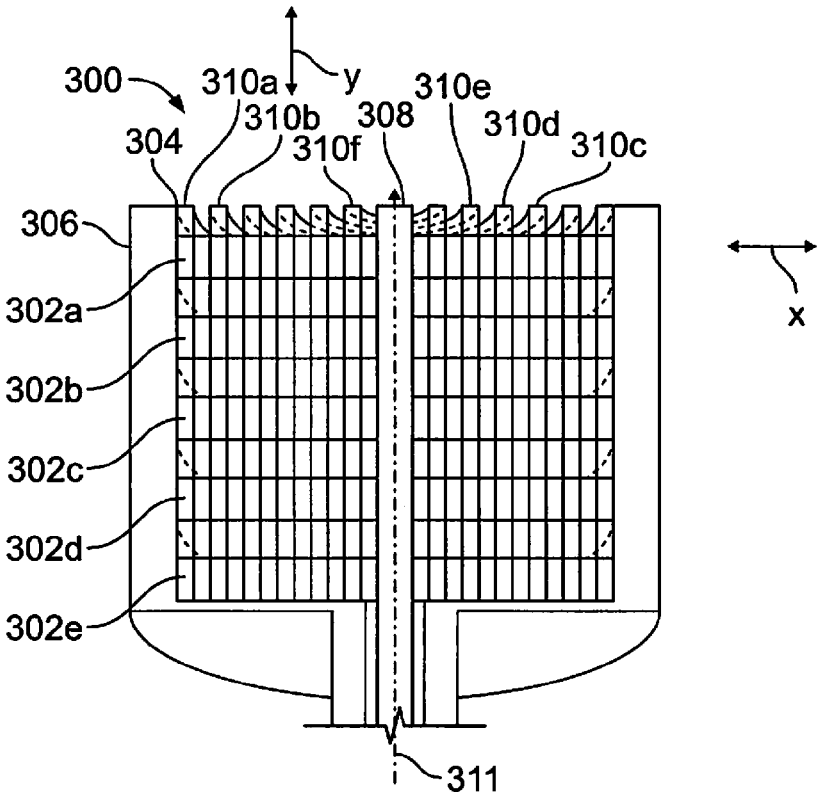
FIG. 7 is a diagrammatic representation of a perspective cross-sectional view of an antenna assembly, according to an embodiment of the present disclosure.

FIG. 7 is a diagrammatic representation of a perspective cross-sectional view of an antenna assembly 300, according to an embodiment of the present disclosure. The antenna assembly 300 is similar to the antenna assembly 100 shown in FIGS. 2-4, except that the antenna assembly 300 includes a plurality of liquid crystal members, such as layers 302*a-e*, that extend between an inner surface 304 of a ground shield 306 and a feed line 308, as well as a plurality of liquid crystal members, such as layers 310*a-f*, that are orthogonally oriented in relation to the liquid crystal layers 302*a-e*. For example, each liquid crystal layer 310*a-f* may be a vertically-oriented cylinder, similar to those shown in FIGS. 5 and 6. As such, the liquid crystal layers 302*a-e* and 310*a-f* form a regular repeating, periodic structure, such as a lattice, that may have dielectric layers at areas therebetween. In at least one embodiment, a dielectric matrix of rims and cylinders may be placed within the antenna assembly 300, and liquid crystal material may then be poured therein, filling the spaces of the dielectric matrix to form the various liquid crystal layers 302*a-e* and 310*a-f*.

Because the liquid crystal layers 302*a-e* are orthogonally connected to the liquid crystal layers 310*a-f* (e.g., the liquid crystal layers 302*a-e* are horizontally oriented with respect to a longitudinal axis 311, while the liquid crystal layers 310*a-f* are vertically oriented with respect to the longitudinal axis 311), the antenna assembly 300 may be tunable in two dimensions, namely in the x direction that is parallel to the horizontal layers 302*a-e*, and the y direction that is parallel to the vertical layers 310*a-f*. Further, because the liquid crystal layers 302*a-e* extend between the ground shield 306 and the feed line 308, the liquid crystal altering bias may be relatively low, such as described with respect to FIGS. 2-4.

Alternatively, the liquid crystal layers 302*a-e* and 310*a-f* may be inverted in relation to the portions of dielectric layers shown therebetween. For example, the portions of dielectric layers shown in FIG. 7 may be liquid crystal layer portions, while the portions of liquid crystal layers shown in FIG. 7 may be dielectric layer portions.

Figure 8:
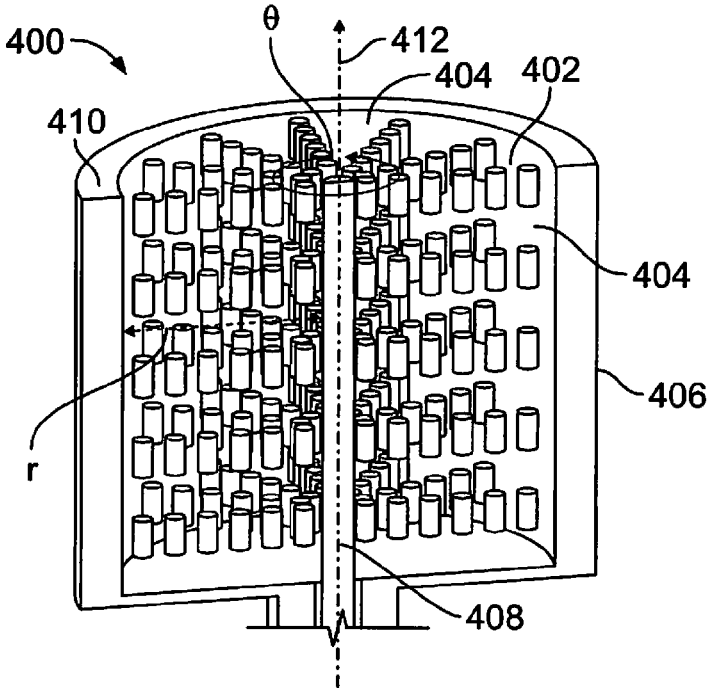
FIG. 8 is a diagrammatic representation of a perspective cross-sectional view of an antenna assembly, according to an embodiment of the present disclosure.

FIG. 8 is a diagrammatic representation of a perspective cross-sectional view of an antenna assembly 400, according to an embodiment of the present disclosure. The antenna assembly 400 is similar to those described above, except that a periodic three-dimensional array of liquid crystal members 402 (such as radial liquid crystal blocks) and dielectric members 404 (such as dielectric members that may be reciprocal and/or complementary to the liquid crystal members 402) is defined between a ground shield 406 and a feed line 408. The dielectric members 404 may be inserted into the ground shield 406 as portions that are suspended together through connecting rods, wires, strings, or the like. Optionally, a dielectric matrix having spaces formed therethrough may be positioned within the ground shield. Liquid crystal material may then be poured into the ground shield and fill the spaces between the dielectric members 406 to form the liquid crystal members 402. The antenna assembly 400 may provide tunability in three dimensions, with respect to a radius r from the feed line 404 to the ground shield 406, a radial angle θ that wraps around the feed line 404, and an angle Φ from a top surface 410 of the antenna assembly 400 to a central axis 412. As shown, the liquid crystal members 402 extend radially and axially from the central longitudinal axis of the feed line 408.

Alternatively, the liquid crystal layers 402 may be inverted in relation to the portions of dielectric layers shown therebetween. That is, the portions of dielectric layers shown in FIG. 8 may be liquid crystal layer portions, while the portions of liquid crystal layers shown in FIG. 8 may be dielectric layer portions.

Figure 9:
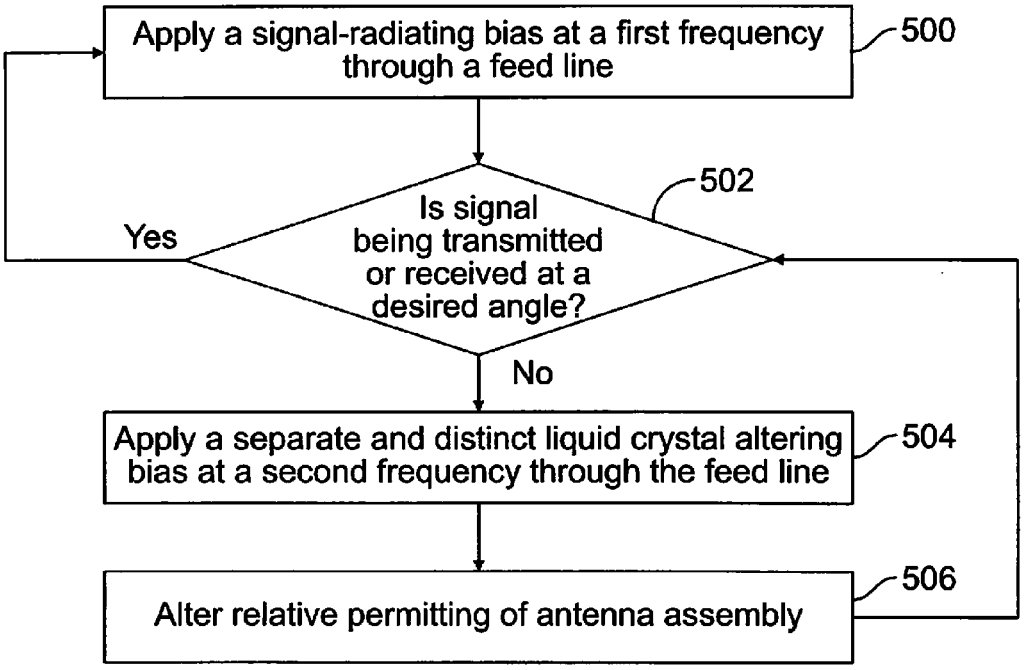
FIG. 9 illustrates a flow chart of a method of operating an antenna assembly, according to an embodiment of the present disclosure.

FIG. 9 illustrates a flow chart of a method of operating an antenna assembly, according to an embodiment of the present disclosure. The method begins at 500, in which a signal-radiating bias at a first frequency (such as a microwave frequency) is applied to a feed line. At 502, it is determined if a signal radiating through the feed line is being transmitted or received at a desired angle. If so, the method returns to 500. If not, the method proceed from 502 to 504, in which a separate and distinct liquid crystal altering bias is applied at a second frequency through the feed line at the same time that the signal-radiating bias is applied at the first frequency through the feed line. At 506, a relative permittivity of the antenna assembly is altered through 504, which, in turn, changes the angle of transmission or reception of the signal. The method then returns to 502.

The phase of each antenna assembly of a phased array antenna system may be altered in this manner, in order to compensate for phase and coupling discrepancies, for example.

Referring to FIGS. 1-9, certain embodiments of the present disclosure provide periodic, repeating patterns of liquid crystal members, such as layers, and dielectric members, such as layers. The geometries of the various members may be other than shown. Further, more or less liquid crystal layers or members and dielectric layers or members than shown may be used.

As noted, the liquid crystal layers and dielectric layers within an antenna assembly may exhibit a periodicity, such as a regular repeating pattern. It has been found that the periodic structures allow for continuous manipulation of a phase of a signal, such as field incident on the antenna assembly.

Further, additional feed lines may be positioned within the antenna assembly. The additional feed lines may be used to apply one or more additional liquid crystal altering biases with respect to the liquid crystal layers, in order to provide various incident field reception angles and/or transmission shapes.

Thus, embodiments of the present disclosure provide systems and methods for reducing phase and coupling errors with respect to antenna assemblies.

The figures of the present application show cylindrical antennas. It is to be understood, however, that embodiments of the present disclosure may be used with various other types of antennas, such as horn, monopole, dipole, and other types of antennas. Embodiments of the present disclosure may be used with any antenna in which dielectric shielding is used to contain a periodic liquid crystal structure between a feed and ground plane, for example.

Figure 10:
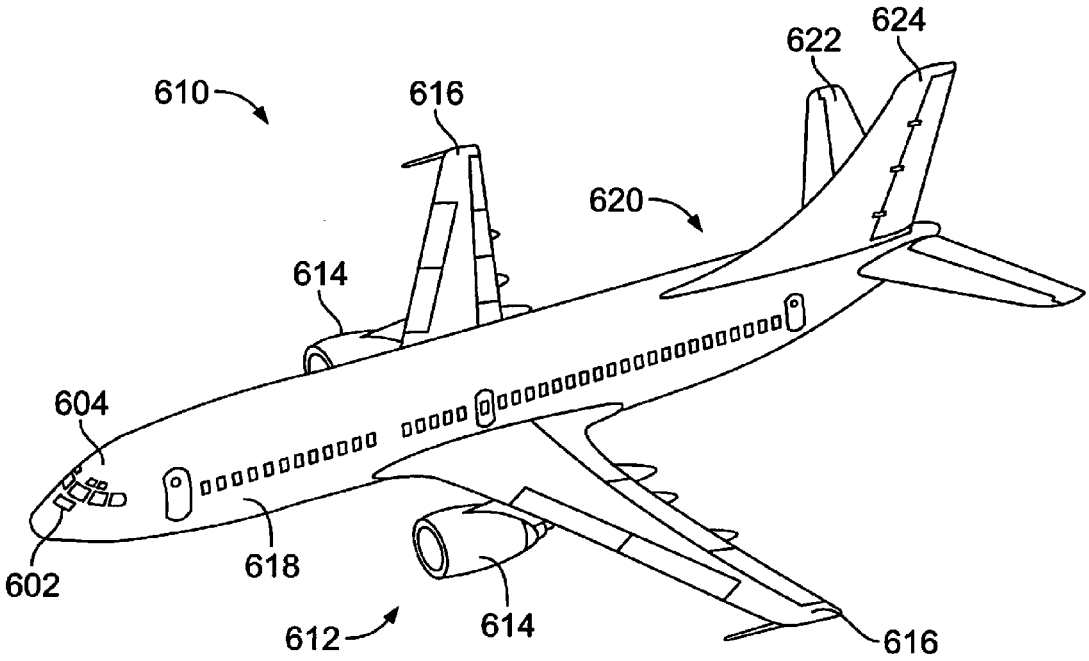
FIG. 10 is a diagrammatic representation of a perspective top view of an aircraft, according to an embodiment of the present disclosure.

FIG. 10 is a diagrammatic representation of a perspective top view of an aircraft 610 (or aircraft assembly), according to an embodiment of the present disclosure. The aircraft 610 is an example of a vehicle that may include an antenna assembly 602, such as any of those described above. For example, the antenna assembly 602 may be within or proximate to a cockpit 604. Alternatively, instead of an aircraft, the systems and methods of embodiments of the present disclosure may be used with various other vehicles, such as automobiles, buses, locomotives and train cars, seacraft, spacecraft, handheld devices (such as cellular phones), and the like.

The aircraft 610 may include a propulsion system 612 that may include two turbofan engines 614, for example. Optionally, the propulsion system 612 may include more engines 614 than shown. The engines 614 are carried by wings 616 of the aircraft 610. In other embodiments, the engines 614 may be carried by a fuselage 618 and/or an empennage 620. The empennage 620 may also support horizontal stabilizers 622 and a vertical stabilizer 624.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An antenna assembly, comprising:

a ground shield defining an interior chamber;

a feed line coupled to the ground shield within the interior chamber;

a plurality of dielectric members; and a plurality of liquid crystal members, wherein each of the plurality of liquid crystal members is spaced apart from another of the plurality of liquid crystal members by at least one of the plurality of dielectric members.

2. The antenna assembly of claim 1, wherein a permittivity of each of the plurality of liquid crystal members changes based on application of a liquid crystal altering bias voltage through the feed line.

3. The antenna assembly of claim 2, wherein the antenna assembly is tuned to accept different phase angles through application of the liquid crystal altering bias.

4. The antenna assembly of claim 1, wherein the liquid crystal altering bias is applied at a first frequency that differs from a second frequency of a signal radiating bias that is concurrently applied through the feed line.

5. The antenna assembly of claim 1, wherein the plurality of dielectric members and the plurality of liquid crystal members form a periodic pattern within the antenna assembly.

6. The antenna assembly of claim 1, wherein the plurality of liquid crystal members comprise a plurality of liquid crystal layers that extend between an inner surface of the ground shield to the feed line.

7. The antenna assembly of claim 1, wherein the plurality of liquid crystal members comprises a plurality of concentric liquid crystal layers, and wherein the plurality of dielectric members comprises a plurality of concentric dielectric cylinders.

8. The antenna assembly of claim 1, wherein the plurality of liquid crystal members comprises:

a first set of liquid crystal layers that extend between an inner surface of the ground shield to the feed line; and a second set of concentric liquid crystal layers that are orthogonal to the first set of liquid crystal layers.

9. The antenna assembly of claim 1, wherein the plurality of liquid crystal members comprises a three dimensional array of liquid crystal members within the ground shield.

10. The antenna assembly of claim 1, wherein each of the liquid crystal members is formed of the same liquid crystal material.

11. The antenna assembly of claim 1, wherein at least two of the liquid crystal members are formed of a different liquid crystal material.

12. A method of operating an antenna assembly, the method comprising:

applying a signal-radiating bias at a first frequency to a feed line that is coaxial with a ground shield; and applying a liquid crystal altering bias at a second frequency that differs from the first frequency to the feed line, wherein the applying a liquid crystal altering bias operation alters a relative permittivity between a plurality of liquid crystal members and a plurality of dielectric members within the ground shield.

13. The method of claim 12, wherein the applying a liquid altering bias operation comprises tuning the antenna assembly to accept different phase angles through application of the liquid crystal altering bias.

14. The method of claim 12, wherein the applying a signal-radiating bias operation and the applying a liquid crystal altering bias operation occur concurrently.

15. The antenna of claim 12, wherein the plurality of dielectric members and the plurality of liquid crystal members form a periodic array within the antenna assembly.

16. An antenna system, comprising:

an antenna assembly including: (a) a ground shield defining an interior chamber, (b) a feed line coupled to the ground shield within the interior chamber, (c) a plurality of dielectric members, and (d) a plurality of liquid crystal members, wherein each of the plurality of liquid crystal members is spaced apart from another of the plurality of liquid crystal members by at least one of the plurality of dielectric members, wherein the plurality of dielectric members and the plurality of liquid crystal members form a periodic pattern within the antenna assembly; and a control unit in operatively coupled to the feed line, wherein the control unit is configured to apply a signal-radiating bias at a first frequency through the feed line and a liquid crystal altering bias at a second frequency that differs from the first frequency through the feed line.

17. The antenna system of claim 16, wherein a permittivity of each of the plurality of liquid crystal members changes based on application of the liquid crystal altering bias through the feed line, wherein the antenna assembly is tuned to accept different phase angles through application of the liquid crystal altering bias.

18. The antenna system of claim 16, wherein the plurality of liquid crystal members comprise a plurality of liquid crystal layers that extend between an inner surface of the ground shield to the feed line.

19. The antenna system of claim 16, wherein the plurality of liquid crystal members comprises a plurality of concentric liquid crystal layers, and wherein the plurality of dielectric members comprises a plurality of concentric dielectric cylinders.

20. The antenna assembly of claim 16, wherein the plurality of liquid crystal members comprises a three dimensional array of liquid crystal members within the ground shield.

* * * * *